United States Patent [19]

Miyama et al.

[11] Patent Number: 4,622,497

[45] Date of Patent: Nov. 11, 1986

[54] FLAT TYPE CATHODE RAY TUBE

[75] Inventors: Hiroshi Miyama, Yokohama; Yoshikazu Kawauchi, Kawasaki; Kaoru Tomii, Isehara; Jun Nishida, Tokyo, all of Japan

[73] Assignee: Matsushita Electric Industrial Co., Ltd., Osaka, Japan

[21] Appl. No.: 708,898

[22] Filed: Mar. 6, 1985

[30] Foreign Application Priority Data

| | | | |
|---|---|---|---|
| Mar. 9, 1984 | [JP] | Japan | 59-45830 |
| Mar. 14, 1984 | [JP] | Japan | 59-49515 |
| Mar. 14, 1984 | [JP] | Japan | 59-49524 |
| Mar. 14, 1984 | [JP] | Japan | 59-49525 |
| Mar. 14, 1984 | [JP] | Japan | 59-49526 |

[51] Int. Cl.[4] ..... H01J 29/70; H01J 29/72

[52] U.S. Cl. ..... 315/366; 313/422

[58] Field of Search ..... 315/366; 313/422

[56] References Cited

U.S. PATENT DOCUMENTS

| | | | |
|---|---|---|---|
| 4,118,650 | 10/1978 | Scott | 315/366 |
| 4,158,210 | 6/1979 | Watanabe et al. | 315/366 |
| 4,417,184 | 11/1983 | Takesako et al. | 313/422 |
| 4,449,148 | 5/1984 | Inohara et al. | 315/366 |

FOREIGN PATENT DOCUMENTS 2619 10/1971 Japan .

*Primary Examiner*—Theodore M. Blum

*Attorney, Agent, or Firm*—Stevens, Davis, Miller & Mosher

[57] ABSTRACT

In a flat type cathode ray tube having a small depth relative to an image screen size, electron beams which are generated by heating vertically extending linear thermal cathodes are sequentially and vertically switched by a plurality of vertical scanning electrodes extending vertically and arranged perpendicularly to the linear thermal cathodes, are transmitted through an electron beam generating electrode having apertures formed therein corresponding to the linear thermal cathodes. The electron beams are horizontally deflected by horizontal deflection electrodes, and then directed to a phosphor layer on an image area of a faceplate. The electron beams are modulated by applying a modulation pulse voltage together with a heating D.C. voltage to the linear thermal cathodes, or by applying a modulation pulse signal to a modulation electrode arranged close to the electron beam generating electrode. A large image screen size is attained by the provision of the plurality of vertically extending linear thermal cathodes.

26 Claims, 28 Drawing Figures

FLAT TYPE CATHODE RAY TUBE

BACKGROUND OF THE INVENTION

The present invention relates to a flat type cathode ray tube for use in a color television receiver set or a computer terminal display.

A prior art flat type cathode ray tube includes a phosphor plane arranged on an inner surface of a vacuum enclosure, a plurality of vertical deflection electrodes arranged in parallel and facing relation to the phosphor plane and vertically divided at a predetermined pitch, and horizontally extending electron guns arranged in a direction of vertical scanning on the phosphor plane to emit electron beams. Each electron gun comprises a thermal electron source for generating thermal electrons, a grid electrode for generating thermal electrons as electron beams corresponding to horizontally arranged pixels and modulation electrodes for modulating respective beams in accordance with a picture signal. The electron beams modulated corresponding to the horizontally arranged pixels are directed to a space between the phosphor plane and the vertical deflection electrode and a deflection voltage to the vertical deflection electrode is sequentially changed so that the phosphor plane is vertically scanned by the electron beams.

In such a flat type cathode ray tube, the electron gun for generating the electron beams should generate electron beams one for each of the horizontally arranged pixels. Since one pixel in a conventional color television image has a size of 0.1–0.2 mm, it is difficult from electrical and mechanical standpoints to generate the electron beams at such a pitch and modulate them individually. Even if it is possible, it is very difficult to keep the spot size of the electron beam constant and keep the incident position precision to the phosphor plane constant for all electron beams over an electron beam travel path between the electron gun and the phosphor plane. Since the voltage on the vertical deflection electrode switches from a voltage equal to that of the phosphor plane to a deflection voltage, switching takes place at a high voltage and a deflection power is fairly large.

SUMMARY OF THE INVENTION

It is an object of the present invention to provide a novel flat type cathode ray tube which resolves problems encountered in the prior art flat type cathode ray tube.

It is another object of the present invention to provide a flat type cathode ray tube with improved electron beam spot size and uniformity, reduced deflection power, improved travel position precision of the electron beam, improved utilization efficiency of the electron beam and with a highly bright image.

It is another object of the present invention to provide a flat type cathode ray tube having a simple structure.

It is another object of the present invention to provide a flat type cathode ray tube which allows beam concentration on a shadow mask at a low voltage.

The flat type cathode ray tube of the present invention comprises one or more linear thermal cathodes for generating electrons when heated, arranged in a vacuum enclosure in parallel with an image plane at the front of the vacuum enclosure, horizontally and spaced apart from each other and extending vertically, and a vertical scanning electrode for vertically switching electron beams, including a grid electrode having openings one for each linear thermal electrode, a horizontal deflection electrode for horizontally deflecting the electron beam and a light emitting layer made of phosphor which emits light by irradiation of the electron beam. The vertical scanning electrode is arranged on the front or rear (back) side of the linear thermal cathode. When it is arranged on the front side, it has electron beam transmission apertures and a back electrode is arranged on the rear side, and the electron beam is taken out by an electric field produced between the back electrode and the grid electrode. On the other hand, when the vertical scanning electrode is on the rear side of the linear thermal electrode, the electron beam is taken out by an electric field established between the vertical scanning electrode and the grid electrode.

The electron beam is modulated by applying a modulation voltage to a modulation electrode arranged corresponding to the linear thermal cathode to be provided with an independent electric potential or applying a heating D.C. voltage and a modulating pulse voltage to the linear thermal cathode to produce the electron beam in accordance with the modulation signal.

In another embodiment, three electron beams are horizontally deflected in a set and irradiated to red, green and blue phosphors on a face plate through a shadow mask.

BRIEF DESCRIPTION OF THE DRAWINGS

Throughout the drawings, like elements are designated by like numerals.

DESCRIPTION OF THE PREFERRED EMBODIMENTS

In order to aid the understanding of the present invention, a typical prior art flat type cathode ray tube is first explained.

Figure 1:
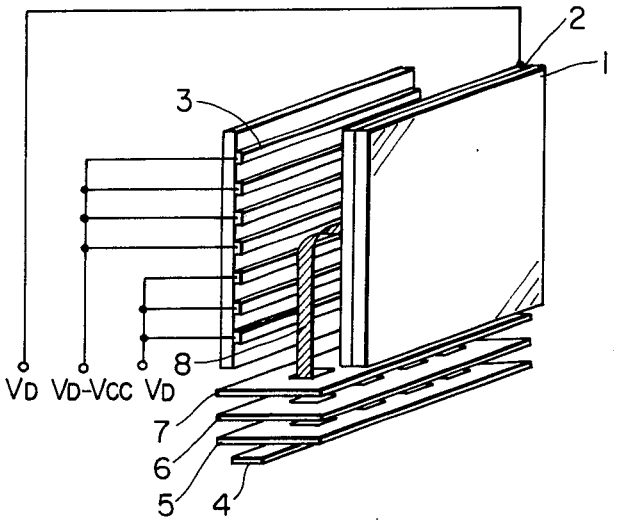
FIG. 1 PRIOR ART
FIG. 1 is a perspective view of a prior art flat type cathode ray tube.

As a prior art flat type cathode ray tube, a structure as shown in Japanese patent application laid-open No. 46-2619 is shown in FIG. 1. A phosphor 2 is formed on an inner surface of a vacuum enclosure 1, vertical deflection electrodes 3 are arranged extending horizontally, in parallel with and opposite to the phosphor 2 and vertically separated from each other by a predetermined pitch, and an electron gun for producing respective electron beams is arranged to extend horizontally and to be placed at a position of extension of the vertical scanning direction of the phosphor plane. In the operation of the flat type cathode ray tube of this structure, thermal electrons generated by heating an electron source 4 are taken out as electron beams 8 from apertures formed in a grid electrode 5 and those beams are modulated by a grid elecrtrode 6. The electron beams are modulated by electrically grouping the apertures and applying beam modulation voltages to the electrodes. The modulated electron beams pass through apertures formed in a shield electrode 7 and travel between the phosphor plane and the opposing vertical deflection electrode 3, straightly where the phosphor plane 2 and the vertical deflection electrode 3 are of the same potential $V_D$ and deflected toward the phosphor plane 2 where the vertical deflection electrode 3 has a potential ($V_D$–$V_{CC}$) lower than the potential ($V_D$) of the phosphor plane 2. The deflection is sequentially performed by each of the vertical deflection electrodes 3 to vertically deflect the electron beam. In this manner, the conventional television image can be displayed on the phosphor plane.

As described above, in the prior art flat type cathode ray tube, it is necessary to horizontally divide the electron beam into as many groups as the number of pixels and modulate them individually. Thus, the manufacture and control thereof are very difficult. It is also difficult to keep the electron beam spot size constant and keep the landing characteristic constant for all beams. In addition, a deflection power is high.

Thus, the prior art flat type cathode ray tube is simple in construction but has many problems in the performance.

The embodiments of the present invention will now be explained.

Figure 2:
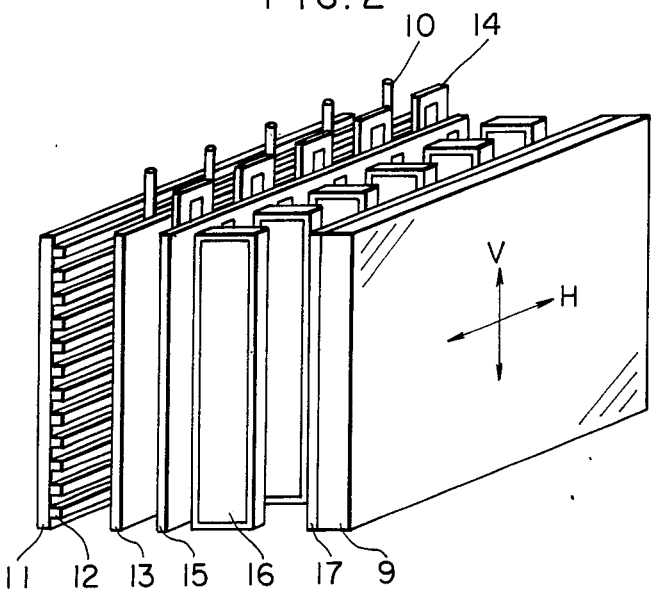
FIG. 2 is a perspective view showing a structure of a flat type cathode ray tube in accordance with a first embodiment of the present invention.

FIG. 2 shows a structure of a flat type cathode ray tube in accordance with a first embodiment of the present invention. Actually, electrodes are contained in a vacuum enclosure (glass vessel), but the vacuum enclosure is omitted in FIG. 2 to clearly show the internal electrodes. Only, a portion of the face constituting the vacuum enclosure is shown. In order to define horizontal and vertical directions of a screen on which an image or character is displayed, the horizontal direction (H) and the vertical direction (V) are shown on the face plate. A plurality of linear thermal cathodes 10 made of tangusten wires having oxide cathodes formed on the surfaces thereof are arranged separately and horizontally at regular intervals, and appropriate tensions are vertically applied thereto. The number of linear thermal cathodes 10 and the space are of a design matter. For example, when the diagonal dimension of the display area is 10 inches, the horizontal space is approximately 10 mm and 20 linear thermal cathodes 10 having a vertical length of approximately 160 mm are arranged. Electrically isolated and horizontally (H) extending vertical scanning electrodes 12 are arranged at a regular pitch in the vertical direction (V) on an insulator support 11 positioned close to the linear thermal cathodes 10 and opposite to its side of the face plate 9. The vertical scan electrodes 12 are metal films or oxide films of conductive material and formed by photo-etching, mask vapor-deposition or screen printing. In order to display the conventional television image, 490 vertical scan electrodes 12 are vertically arranged. Arranged between the linear thermal cathodes 10 and the face plate 9 are a first planar grid electrode 13 having apertures formed at positions corresponding to the linear thermal cathodes 10 to focus and accelerate the electron beam, second modulation grid electrodes 14 one for each of the linear thermal cathode 10, electrically isolated and having electron beam transmission apertures, and a third grid electrode 15 having a similar shape to the first grid electrode 13. Horizontal deflection electrodes 16 for horizontally deflecting the electron beams transmitted through the electron beam transmission apertures formed in the electrodes 13, 14 and 15 are arranged being electrically isolated and facing the electron beams transmitted through the apertures of the electrodes. The horizontal deflection electrodes 16 have metal films formed to be electrically isolated on both surfaces of substrates such as insulating supports. A layer 17 which emits light upon stimulation by the electron beam is arranged on the inner surface of the face plate 9. It is formed by a phosphor or a metal-back layer. The phosphor may be of one layer for a monochromatic display, and red, green and blue stripes or dots are formed for a color display.

Figure 3:
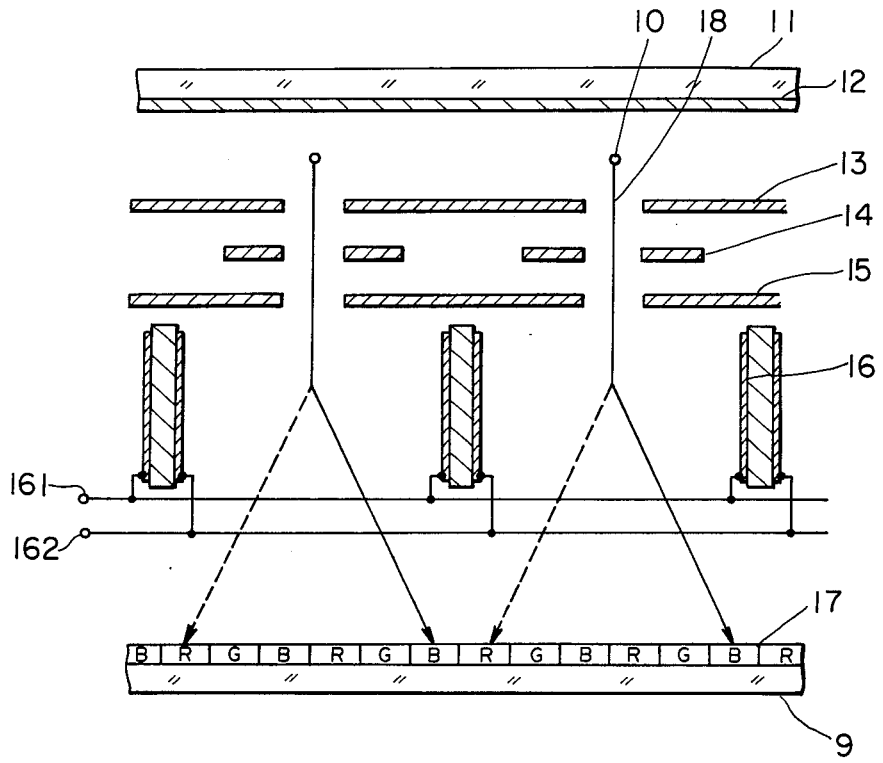
FIG. 3 is a cross-sectional view of the structure of FIG. 2.
Figure 4:
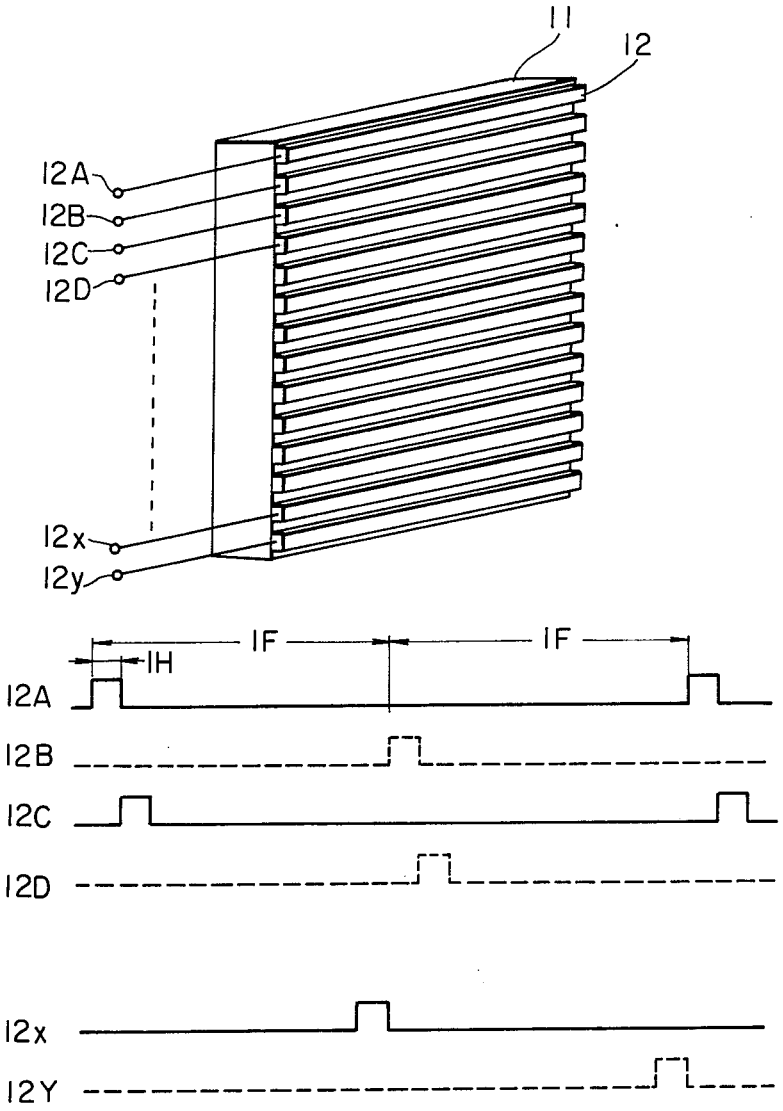
FIG. 4 illustrates a vertical scanning operation performed by the structure of FIG. 2.

Referring to FIGS. 3 and 4, the operation of the flat type cathode ray tube is described. FIG. 3 is a horizontal sectional view of the flat type cathode ray tube shown in FIG. 2. Electrons generated by heating the linear thermal cathodes 10 pass through the electron beam transmission apertures of the first grid electrode 13 opposing to the linear thermal cathodes 10, by an electric field established between the vertical scanning electrodes 12 on the back of the linear thermal cathodes 10 and the first grid electrode B. While the electron beams are not visible, loci 18 of the electron beams are shown to facilitate understanding. The electron beams transmitted through the apertures of the first grid electrode 13 are modulated (e.g. on-off modulation) by the second modulation grid electrodes 14 each of which corresponds to each of the linear thermal cathodes 10 and each of which is electrically isolated from the other grid electrodes 14. If the tube is used for a color display, sequential modulation signals designated as red, green, blue, red, green, blue,—are applied. The electron beams produced by the linear thermal cathodes 10 are modulated by respective modulation signals. The third grid electrode 15, having a similar shape as the first grid electrode 13, presents a shield effect and horizontally focuses the electron beams. The horizontal deflection electrodes 16 are arranged one for each linear thermal cathode 10 to face the electron beam. A sawtooth or stepwise horizontal deflection voltage is applied to the horizontal deflection electrodes 16 through wires 161 and 162 so that the electron beams are horizontally deflected by a predetermined length. The horizontally deflected electron beams are then electrically accelerated and stimulate the light emitting layer 17 formed on the inner surface of the face plate 9 so that the light emitting layer 17 emits lights. When a color display is required, the electron beams are horizontally deflected and modulation signals for the rspective colors are supplied to the second modulation grid electrodes 14 at predetermined positions for the respective colors so that a color image is displayed.

The electron beams 18 produced by the linear thermal cathodes 10 are modulated by the modulation signals and horizontally focused and deflected so that selected areas of the phosphor 17 emit light as described above. The electron beams should also be switched in the vertical direction for each scanning line. When the television image is to be displayed, for example, as shown in FIG. 4, in order to effect vertical switching of the electron beams, 490 electrically separated vertical scanning electrodes 12 are arranged at the back of the linear thermal cathodes 10. The electrodes are formed by metal films or a conductive material such as oxide films on the insulator 11 by a photo-etching technique. Alternatively, a metal plate may be photo-etched. A vertical scanning signal is applied to each of the separated vertical scanning electrodes 12. The applied signal effects an "ON" or "OFF" operation of the electron beams. In a first field, the electron beam is turned on only for a 1H-period by the signal applied to a terminal 12A. The signal for turning on the electron beam only for a next 1H-period is applied to a terminal 12C, and so on. Thus, similar signals each thereof turning on the electron beam for a 1H-period are applied to every other vertical scanning electrode. When the signal is applied to a terminal 12X at the bottom of the screen, the scan for the first field is completed, and then an interlace scan is initiated to vertically scan a second field. In the second field, signals each thereof turning on the electron beam only for a 1H-period are applied, starting from a terminal 12B to subsequent every other terminals. When the signal is applied to the lowermost terminal 12Y, the scan for one frame is completed.

As described above, in the flat type cathode ray tube of this invention, the plurality of linear thermal cathodes 10 are arranged at the horizontally spaced positions in the vacuum vessel. The vertical scanning electrodes 12 of a number corresponding to that of the horizontal scanning lines are arranged perpendicularly to the linear thermal cathodes 10 at the back of the linear thermal cathodes 10 so that the vertically uniform electron beams produced by heating the linear thermal cathodes 10 are sequentially turned on and off. Then, the electron beams are modulated by the individual separated second modulation grid electrodes 14 which are arranged to correspond to the respective linear thermal cathodes 10, and then the electron beams are horizontally focused and deflected. Thus, light is emitted at predetermined areas on the phosphor plane 17 and a combined image, character, etc. is displayed on the screen.

Figure 5:
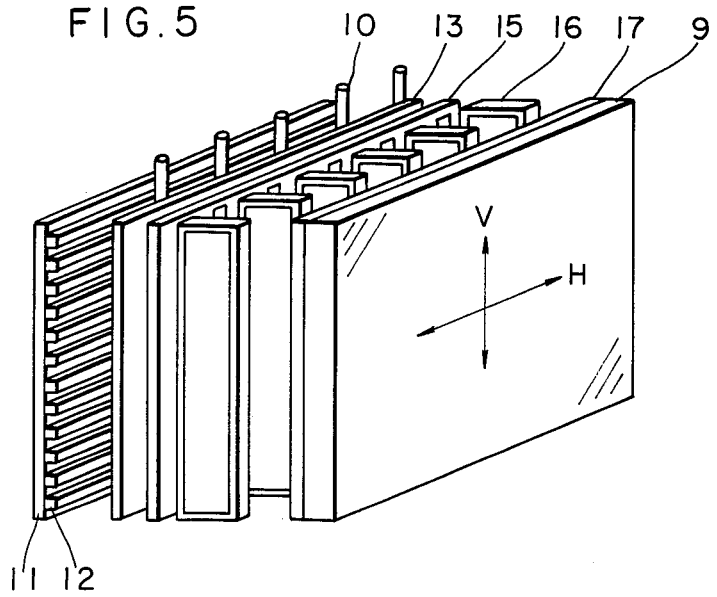
FIG. 5 is a perspective view of a flat type cathode ray tube in accordance with a second embodiment of the present invention.

Referring to FIG. 5, a second embodiment of the present invention is explained. In the present embodiment, the second modulation grid electrodes 14 in the structure shown in FIG. 2 are omitted and the modulation is effected by the linear thermal cathodes 10.

Figure 6A:
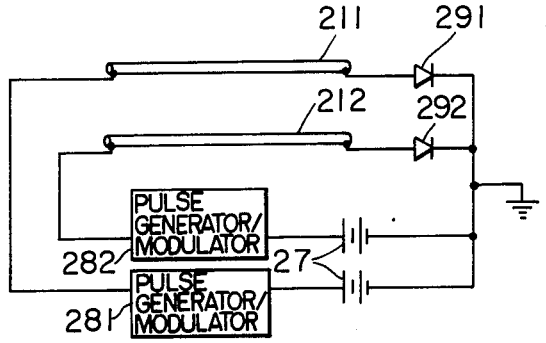
FIGS. 6A and 6B are a circuit diagram and a waveform diagram for explaining an operation of the structure of FIG. 5.
Figure 6B:
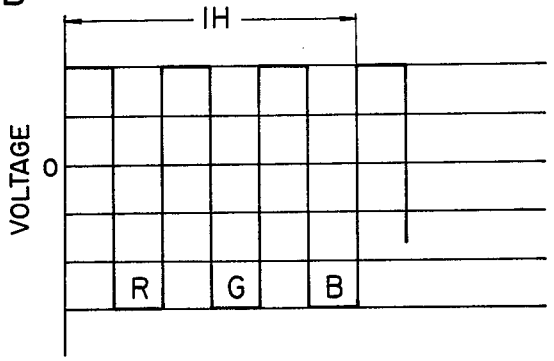

The operation of the present flat type cathode ray tube is now explained. Referring to FIG. 6A, the linear thermal cathodes 211 and 212 are continuously powered by a power supply 27 so that they are heated to approximately 700° C. and are conditioned to emit electrons. However, since a negative voltage relative to the cathodes is applied to the counterelectrode (first grid electrode 13) which collect the electron beams, the electron beams cannot pass through the beam transmission apertures of the counterelectrode. By applying negative pulse voltages higher that the voltage of the opposing first grid electrode 13 to the linear thermal cathodes by pulse generation/modulation circuits 281 and 282, the first grid electrode 13 is rendered positive relative to the cathodes to cause an electron current to flow so that electron beams proportional to the pulse voltage are obtained. Diodes 291 and 292 are reverse-biased under this condition so that no current flows to the linear thermal cathodes 211 and 212 and potential differences across both ends of the respective linear thermal cathodes 211 and 212 are substantially zero. Accordingly, all portions of the respective linear thermal cathodes 211 and 212 possess the same potential and uniform electron currents are obtained in the cathodes. Here, pulse-width modulated signals modulated by the video signal may be applied to the linear thermal cathodes 211 and 212. For example, as shown in FIGS. 6A and 6B, in addition to a D.C. voltage for heating the linear thermal cathodes, if a color display is needed, the pulse-width modulated signals corresponding respectively to red, green and blue colors are applied to the linear thermal cathodes 211 and 212 during a horizontal scanning period so that the electron currents modulated by the video signals are obtained.

Turning to FIG. 5, in the same manner as the first embodiment, pulse signals are applied to the vertical scanning electrodes 12 arranged close to the back of the linear thermal cathodes 10 so that the vertically uniform electron beams produced by the linear thermal cathodes 10 are vertically scanned. Then, the electron beams generated by the linear thermal cathodes 10 are horizontally focused by the first grid electrode 13 and the third grid electrode 15, horizontally deflected by the horizontal deflection electrodes 16, and then accelerated. Then, the electron beams scan predetermined areas of the light emitting layer 17 formed on the inner surface of the face plate 9, thereby obtaining an image. When the light emitting layer 17 is a color screen having red, green and blue phosphor stripes, it is a matter of course that the positions corresponding to the respective colors on which the horizontally deflected electron beams impinge are made to coincide with the timing of application of the pulse-width modulation signal to the linear thermal cathodes 10.

As described above, in the second embodiment, the modulation signals such as video signals are applied to the linear thermal cathodes 10, so that the modulation electrodes 14 provided to correspond to the respective linear thermal cathodes 10 in the first embodiment can be omitted. This leads to reduction of cost.

Figure 7:
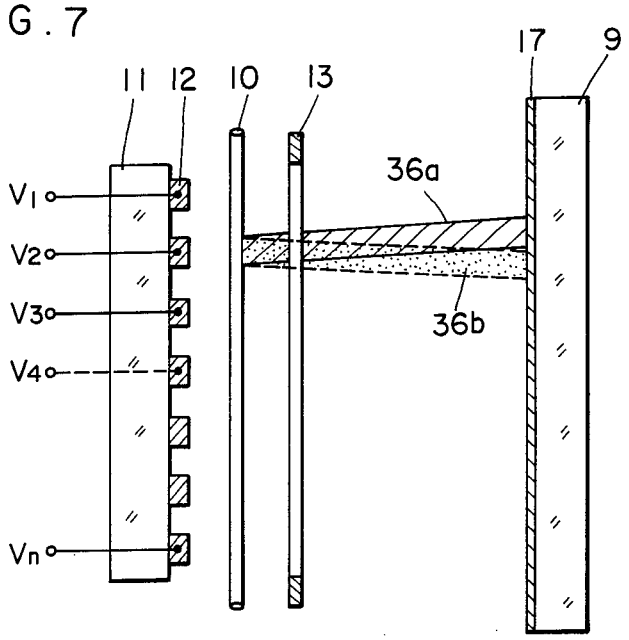
FIG. 7 is a partial longitudinal sectional view of a flat type cathode ray tube in accordance with a third embodiment of the present invention.

Referring to FIG. 7, a third embodiment is explained. Numeral 10 denotes linear thermal cathodes, numeral 12 denotes vertical scanning electrodes formed on an insulating support 11, and numeral 13 denotes a first grid electrode for forming electron beams. A light emitting layer 17 made of phosphor is formed on an inner surface of a face plate 9. While not shown in FIG. 7, electrodes for horizontally focusing the electron beams and horizontal deflection electrodes are arranged between the first grid electrode 13 and the light emitting layer 17, as they are arranged in the first and second embodiments. The operation is now explained. The electron beams generated by heating the linear thermal cathodes 10 are moved toward the light emitting layer 17 by potentials applied to the first grid electrode 13 and the vertical scanning electrodes 12. A pulse signal is applied to the vertical scanning electrodes 12 to turn on and off the electron beams so that the screen is sequentially scanned from the top to the bottom. In the first and second embodiments, as many vertical scanning electrodes as the number (490) of horizontal scanning lines in the conventional television system are provided. In the present embodiment, one half (245) of that number of vertical scanning electrodes are provided. Assuming that an electron beam is now generated at a position corresponding to $V_2$, potentials $V_1$ and $V_3$ of the vertical scanning electrodes adjacent to the vertical scanning electrode for $V_2$ are selected to be $V_1 > V_3$ in the first field so that the electron beam from $V_2$ is slightly deflected toward $V_1$ as shown by a solid line 36*a*. In the second field, the potentials $V_1$ and $V_3$ are selected to be $V_1 < V_3$ so that the electron beam is slighty deflected toward $V_3$ as shown by a broken line 36*b*. By conducting the above operation for each of the vertical scanning electrodes, the interlaced scanning of the first field and the second field is attained. Since the number of vertical scanning electrodes is reduced to one half, the wiring is facilitated and the number of parts is reduced.

Figure 8:
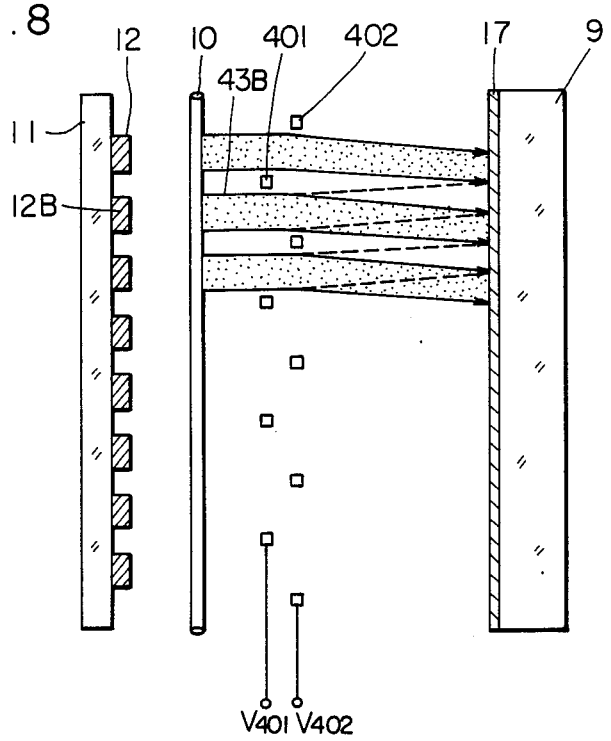
FIG. 8 is a partial longitudinal sectional view of a flat type cathode ray tube in accordance with a fourth embodiment of the present invention.

Referring to FIG. 8, a fourth embodiment of the present invention is now explained. FIG. 8 shows a lateral sectional view of a flat type cathode ray tube similar to FIG. 7. Certain electrodes which are not pertinent to the present embodiment are omitted. Vertical deflection plates 401 and 402 for vertically deflecting electron beams are arranged between linear thermal cathodes 10 and a face plate 9 which serves as a vacuum enclosure. Vertical sanning electrodes 12, which are arranged close to the back of the linear thermal cathodes 10 and are of half a number of horizontal scanning lines, are arranged being electrically isolated and vertically on an insulating support 11. The vertical deflection electrodes 401 and 402 are planar metal electrodes having vertical bars arranged at double pitch with respect to that of the vertical scanning electrodes 12. The bars on the vertical deflection electrodes 401 and 402 have a phase difference of 180° from each other. A signal which turns on the electron beam only for one horizontal scanning period is applied to each of the vertical scanning electrodes 12 arranged close to the back of the linear thermal cathodes 10 so that the electron beams are sequentially and vertically switched (scanned) by the signal. For example, the electron beams 43B (actually invisible) from the vertical scanning electrode 12B is guided to the face plate 9 by a beam guide electrode (not shown) and vertically deflected slightly by the vertical deflection electrodes 401 and 402 in the first field. The deflection may be effected by making the potentials applied to the respective electrodes different. For example, the voltages $V_{401}$ and $V_{402}$ applied to the respective electrodes are selected to be $V_{401} > V_{402}$ so that the electron beam is deflected toward the electrode 402. In the second field, the potential relationship is reversed ($V_{401} < V_{402}$) so that the electron beam is deflected toward the electrode 401. In this manner, the electron beams in the first field and the second field are interlaced to attain the conventional television scanning. In the present embodiment, the vertical scanning electrodes 401 and 402 are two electrodes arranged in the direction of travel of electron beam. Alternatively, electrically divided coplanar electrodes may be used to attain the same effect. A single vertical deflection electrode having bars arranged at the same pitch as the vertical scanning electrodes and offset relative to the vertical scanning electrodes may be used with a potential applied to the vertical deflection electrode being changed to vertically deflect the electron beams.

In the present embodiment, since the number of vertical scanning electrodes 38 is one half of the number of horizontal scanning lines, the wiring is simplified, the number of circuit parts is reduced and power consumption and cost are also reduced.

In the present embodiment, the number of grid electrodes, the number of linear thermal electrodes and the positions of the electrodes are of design matters. For example, the horizontal deflection electrodes may be of a plate shape or may be arranged between the first grid electrode and the second grid electrode. A single linear thermal cathode may be used. The electron beam transmission apertures of the grid electrodes may be complete slits or dot-shaped apertures which correspond to the vertical scanning electrodes.

The embodiments of FIGS. 7 and 8 are applicable to the structure shown in FIG. 2 having independent modulation electrodes and also to the structure of FIG. 5 having no independent modulation electrode and applying the modulation signal to the linear thermal cathodes to effect the modulation.

Figure 9:
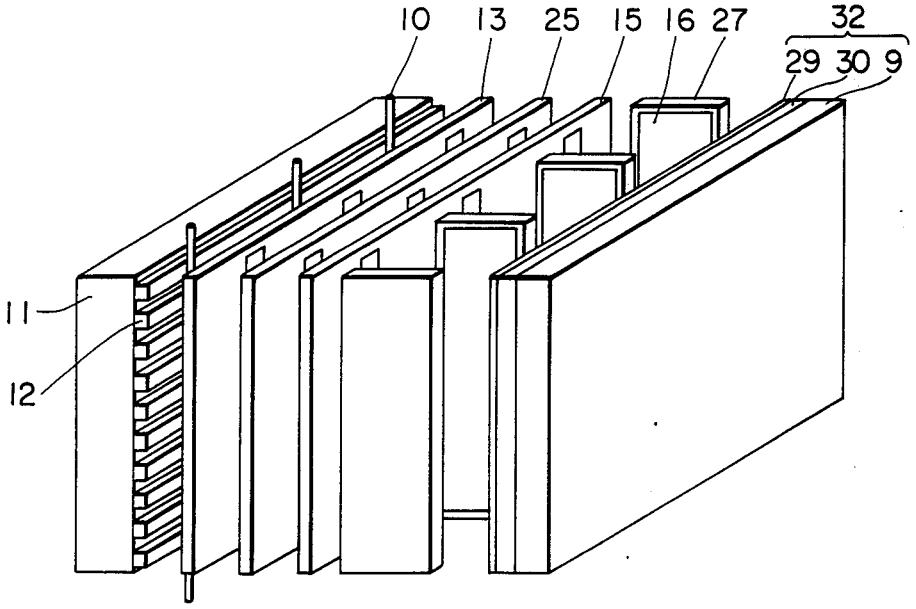
FIGS. 9 and 10 are a perspective view and a horizontal sectional view respectively of a flat type image display in accordance with a fifth embodiment of the present invention.
Figure 10:
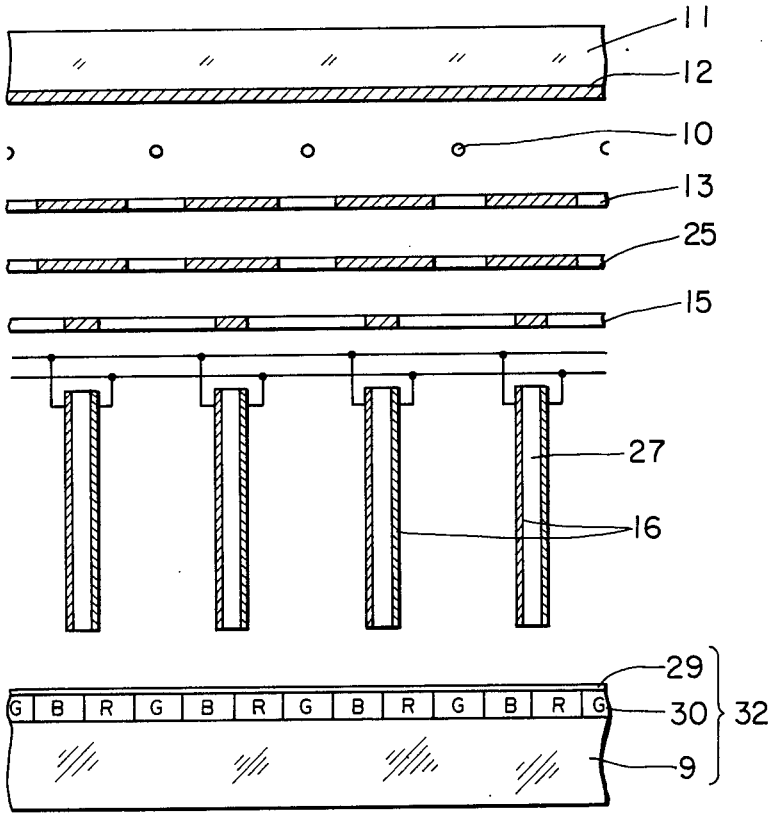

FIG. 9 shows a perspective view of a fifth embodiment of the present invention, and FIG. 10 shows a horizontal sectional view thereof. Actually, the respective electrodes are contained in a vacuum enclosure (glass vessel) but the vacuum enclosure is omitted in the drawings to clearly show the internal electrodes. A portion of a face which serves as the vacuum enclosure is shown.

One or more linear thermal electrodes 10 are arranged at a predetermined horizontal pitch and with vertical tension being applied thereto. Horizontally extending and electrically separated vertical scanning electrodes 12 are arranged at a constant vertical pitch and perpendicularly to the linear thermal cathodes 10, on an insulating support 11 closely to the back of the linear thermal cathodes 10. To display the conventional television image, approximately 480 vertical scanning electrodes 12 are vertically arranged. Arranged between the linear thermal cathodes 10 and the face plate 9 are a first beam generating planar grid electrode 13, a shield electrode 25 and a third beam focusing grid 15. Horizontal deflection electrodes 16 for horizontally deflecting the electron beams transmitted through the apertures of the electrodes 13, 25 and 15 are arranged. The horizontal deflection electrodes 16 are formed on both sides of vertically extending insulating supports 27 and are arranged symmetrically with respect to the center axis of the election beam. A phosphor layer 30 which emits lights upon stimulation by the electron beams is formed on the inner surface of the face plate 9, spaced from the horizontal deflection electrodes 16, and a screen 32 having a metal-back layer 29 formed thereon is arranged. The phosphor layer 30 may be a single phosphor layer for monochromatic display, and phosphor stripes or dots which emit red, green and blue light beams are vertically arranged on the screen for color display.

The operation of the flat type cathode ray tube is now explained. By applying a voltage higher than the potential of the linear thermal cathodes 10 to the first grid electrode 13, the electron beams generated by heating the linear thermal cathodes 10 pass through the apertures of the first grid electrode 13. A voltage equal to or slightly lower than the potential of the linear thermal cathodes 10 is applied to the vertical scanning electrodes 12, and a video signal is superimposed on the linear thermal cathodes 10 so that modulated beams are emitted therefrom. The electron beams transmitted through the apertures of the first grid electrode 13 pass through the apertures of the shield electrode 25. The shield electrode 25 serves to prevent the beam currents from being changed by the first grid electrode 13 under the influence of the voltage applied to the third grid 15. The electron beams transmitted through the apertures of the shield electrode 25 are focused by the third grid electrode 15 into small beam spots on the phosphor layer 30 on the screen 32. The election beams are horizontally deflected by a sawtooth or stepwise deflection voltage having the horizontal scanning period applied to the horizontal deflection electrodes 16, and scan the screen 32 to emit light from the phosphor layer 30. Since the electron beam emitted from each of the linear thermal cathodes 10 is horizontally scanned between the pair of horizontal deflection electrodes 16, it constructs a portion of the horizontal lines on the screen 32.

Next, the vertical switching of the electron beams corresponding to respective horizontal scanning lines and the beam modulating operation are explained.

Figure 11:
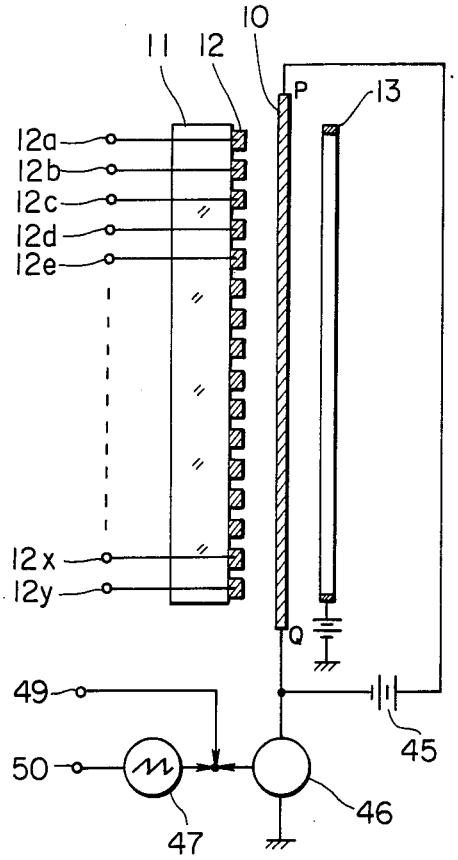
FIG. 11 is a power supply diagram for a linear thermal cathode and a vertical scanning electrode of the flat type image display.
Figure 12A:
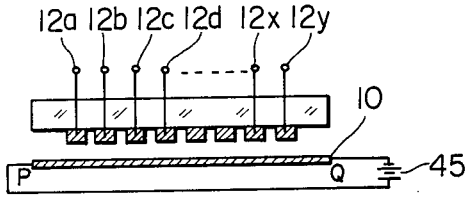
FIGS. 12A and 12B are a sectional view of the vertical scanning electrode and a waveform chart for explaining an operation of the flat type image display.
Figure 12B:
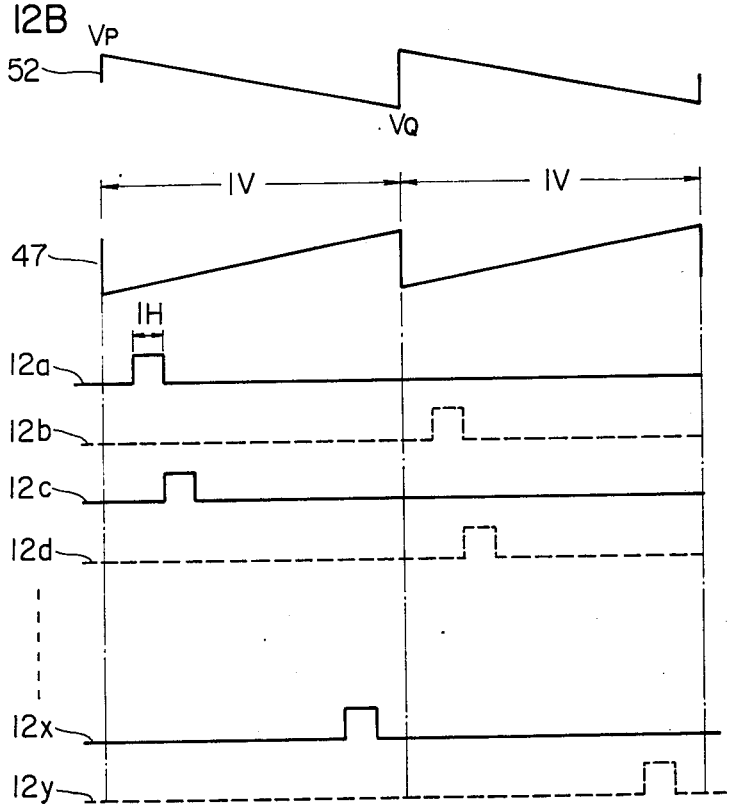

As shown in FIGS. 11, 12A and 12B, horizontally extending vertical scanning electrodes 12 of a number equal to the number of scanning lines necessary for forming an effective screen, for example, 480 for a conventional television image, are vertically arranged close to the back of the linear thermal cathodes 10, and the vertical scanning signals are applied to those electrodes 12. The generation of the beams toward the first grid electrode 13 is controlled by changing the voltages of the vertical scanning electrodes 12 such that the potential of the space around the linear thermal cathodes 10 is positive or negative relative to the potential of the linear thermal cathodes 10. Referring to FIGS. 12A and 12B showing a case of displaying a television image which adopts the interlaced system, a signal **12*a* which turns on the beam (allows the beam to be directed to the first grid electrode) only for one horizontal scanning period (1H-period) is applied to a terminal 12*a* in the first field, then a signal 12*c* which turns on the beam only for the next 1H-period is applied to a terminal 12*c* and similar signals which turn on the beam only for IH-period are sequentially applied to every other vertical scanning electrodes, and when the signal is applied to a terminal 12*x* at the bottom of the screen, the vertical scan in the first field is completed. In the second field, a signal 12*b* which turns on the beam only for IH-period is applied to a terminal 12*b*, and when a similar signal is finally applied to a terminal 12*y***, the vertical scan for one frame is completed.

The signals applied to the terminals **12*a*, 12*b*, . . . 12*y* shown in FIG. 12A are illustrated in FIG. 12B** with identical designations.

Since the linear thermal cathodes 10 are connected to a heating power supply 45, there is a potential difference between an input terminal P and an output terminal Q of the current. This is shown by a waveform 52 in FIG. 12B. Thus, to control the generation of the beams from the linear thermal cathodes 10, the signal voltages **12*a*, 12*b*, . . . applied to the vertical scanning electrodes 12 should be changed such that the potential difference between the vertical scanning electrode and the corresponding linear thermal cathode 10 is constant, and other electrode voltages should also be controlled so that the potential difference from the potential of the beam generating linear thermal cathodes 10 is constant. Such correction renders the circuit complex and increases power consumption. In order to resolve this problem, a sawtooth wave (47 in FIG. 12B) or stepwise wave synchronized with the vertical scanning is generated by a sawtooth or stepwise wave signal generator 47 in accordance with a vertical synchronization signal 50 and it is applied to a linear thermal cathode potential correction power supply 46, and a linear thermal cathode heating power supply 45 is serially connected to the power supply 46 so that the potential of the beam generating area of the linear thermal cathodes 10 is always kept constant. By applying a video signal to a video signal input terminal 49 and applying a sum of this video signal and the output from the stepwise wave signal generator 47 to the linear thermal cathode potential correction power supply 46, the electron beams modulated by the video signal can be extracted from the linear thermal cathodes 10 toward the first grid electrode 13. Accordingly, it is not necessary to extract the beams from the linear thermal cathodes and modulate them by individulally separated modulation electrodes as are done in the prior art structure shown in FIG. 1**. Therefore, the modulation electrodes are not necessary.

Figure 13:
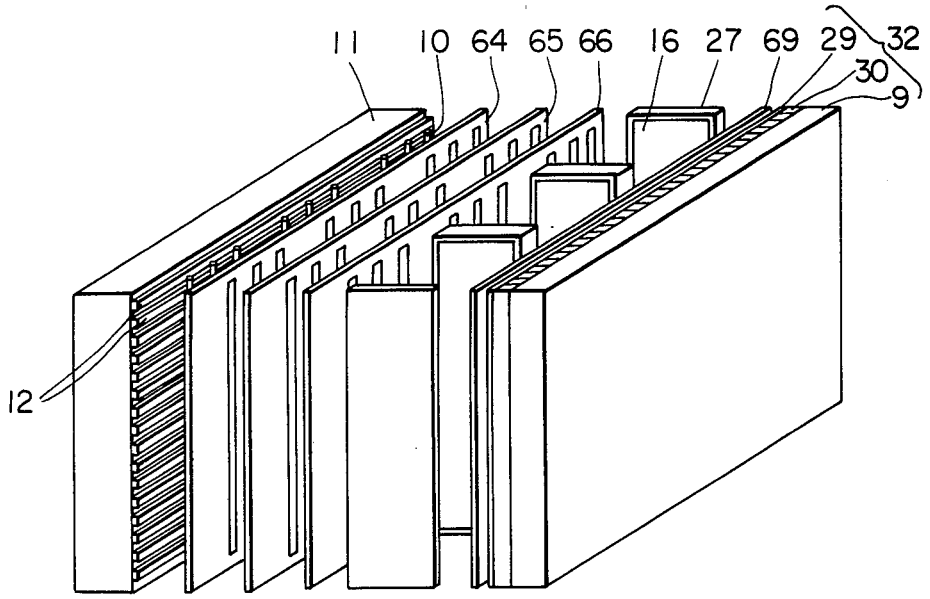
FIGS. 13 and 14 are a perspective view and a cross-sectional view of a flat type image display in accordance with a sixth embodiment of the present invention.
Figure 14:
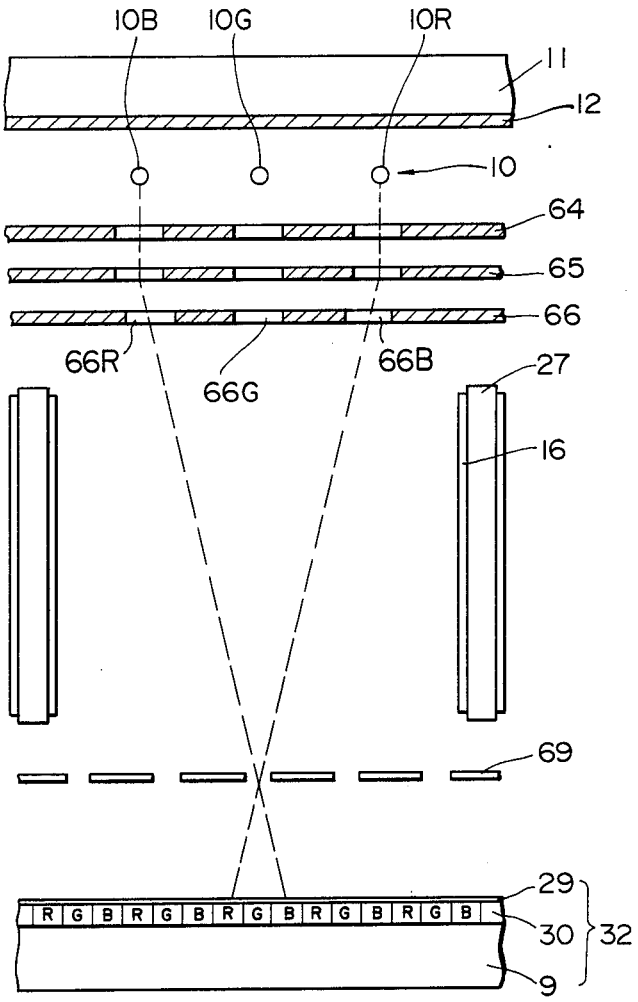

A sixth embodiment of the present embodiment is shown in FIGS. 13 and 14. FIG. 13 shows a perspective view and FIG. 14 shows a horizontal sectional view. Structual differences from the embodiment of FIG. 9 are that **3*n* linear thermal cathodes 10 are provided, where n is a positive integer, the horizontal deflection electrodes 16 are arranged for every third linear thermal cathode 10, and a shadow mask 69 is provided between the horizontal deflection electrodes 16 and the screen 32 in parallel and spaced relation to the screen 32**.

Referring to FIG. 14, the operation is now explained. The operations of the linear thermal cathodes 10 and the vertical scanning electrodes 12 are identical to those in the embodiment of FIG. 9. Of the three linear thermal cathodes, the cathode 10B receives a blue video signal, the cathode 10G receives a green video signal and the cathode 10R receives a red video signal, and the beams modulated by those signals are directed to the apertures of the beam extraction electrode 64. They pass through the apertures of the shield electrode 65 and are directed to the beam focusing electrode 66, which has an aperture 66G positioned on the center axis of the apertures of the beam extraction electrode 64 and the shield electrode 65 and apertures 66R and 66B positioned on the opposite sides of the aperture 66G and having center axes thereof shifted toward the aperture 66G by a predetermined distance. A plurality of such sets of three apertures 66R, 66G and 66B are horizontally arranged.

Thus, the beam transmitted through the aperture 66G moves along the center axis toward the horizontal deflection area. The beams transmitted through the apertures 66B and 66R are deflected by the electric field between the shield electrodes 65 and the beam focusing electrode 66 so that three beams are concentrated to one point on the shadow mask 69. Color phosphors are deposited on the areas of the screen to which the beams transmitted through the apertures of the shadow mask 69 are directed so that light beams in desired colors are emitted. The horizontal deflection electrodes 16 are formed on both sides of vertically extending insulating supports 27 and are arranged at the same pitch as the sets of apertures of the beam focusing electrode 66 and symmetrically to the center axis of the aperture 66G of the beam focusing electrode 66 located on the center axes of the apertures of the beam extraction electrode 64 and the shield electrode 65.

Figure 15:
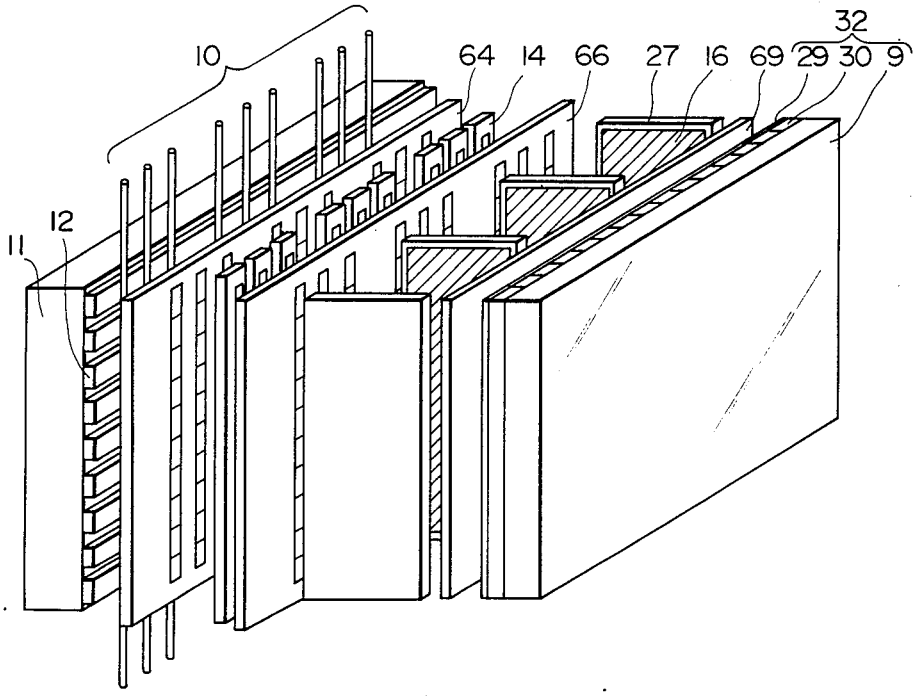
FIGS. 15 and 16 show a perspective view and a cross-sectional view of a flat type cathode ray tube in accordance with a seventh embodiment of the present invention.
Figure 16:
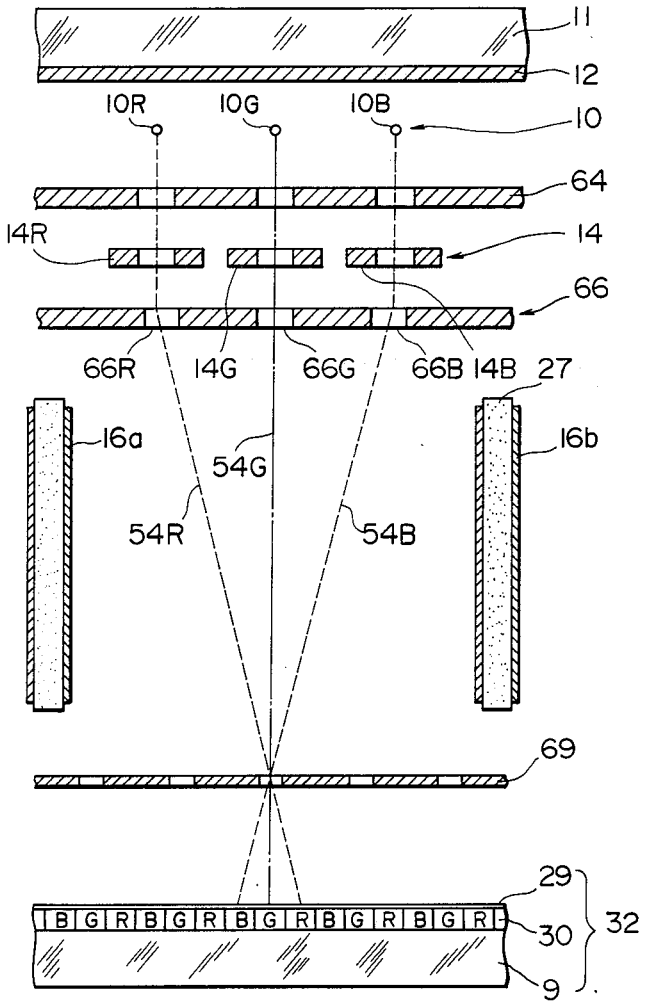

FIGS. 15 and 16 show a seventh embodiment of the present invention. Instead of the shield electrode 65 in the structure shown in FIGS. 13 and 14, modulation electrodes 14 having electron beam transmission apertures one for each of the linear thermal cathodes 10 and electrically separated from each other are provided. Other electrodes are identical to those shown in FIG. 13. The modulation electrodes 14 are arranged such that the electron beam transmission apertures thereof coincide with the electron beam transmission apertures of the first grid electrode 64, as shown in FIG. 16. On the other hand, the electrode 66 has an aperture 66G located on the common center axis of the aperture of the beam extraction electrode 64 and that of the modulation electrode 14 and apertures 66R and 66B located on the opposite sides of the aperture 66G and having centers thereof shifted toward the aperture 66G by a predetermined distance. A plurality of such sets of three apertures 66R, 66G and horizontally arranged. The electrode 66 serves to focus electron beams and simultaneously to converge three electron beams onto one point on the shadow mask 69.

The operation of the present flat type cathode ray tube is now explained. By applying a voltage to the beam extraction electrode 64 such that the potential of the beam extraction electrode is higher than the potential of the linear thermal cathodes 10, the beams generated by heating the linear thermal cathodes 10 are transmitted through the apertures of the beam extraction electrode 64. A voltage equal to or slightly lower than the potential of the linear thermal cathodes 10 is applied to the vertical scanning electrodes 12. The beams transmitted through the beam extraction electrode 64 are modulated by the modulation electrodes 14 electrically separated one for each linear thermal cathode 10. Looking at one channel shown in FIG. 16, red, green and blue modulation signals are applied to the modulation electrodes 14R, 14G and 14B. The modulated beams are forcused by the beam focusing electrode 66. Since the apertures 66R and 66B of the beam focusing electrode 66 are offset from the center of the modulation electrode 14, the beams 54R and 54B transmitted through the apertures 66R and 66B are deflected toward the beam 54G and converged to one point on the shadow mask 69. The beams transmitted through the beam focusing electrode 66 are horizontally deflected by a predetermined width by applying a horizontal deflection voltage, which is a sawtooth or stepwise wave having a horizontal scanning period, to the horizontal scanning electrodes 16. The beam deflection voltage and the D.C. voltage equal to the voltage applied to the screen and the shadow mask are applied to the horizontal deflection electrode 16. The beam is focused by an electrostatic lens formed by the apertures of the electrode 66 by rendering the voltage of the beam focusing electrode 66 to be lower than the voltage of the screen voltage. Since the apertures 66R and 66B of the electrode 66 are horizontally deviated from the center of the aperture of the modulation electrode 14, the beams are deflected by the lens formed by the modulation electrode 14 and the beam focusing electrode 66 so that three beams are converged into one point on the shadow mask.

Defocusing of the beam and the convergence error due to the horizontal deflection are corrected by applying a correction signal synchronized with the horizontal synchronization signal to the beam focusing electrode 66. The deflected electron beams pass through the apertures formed in the shadow mask 69. Phosphor 30R which emits red light is deposited at the position on the screen 32 to which the beam 54R is directed, green phosphor 30G is deposited at the position on the screen 32 to which the beam 54G is directed, and blue phosphor 30B is deposited at the position on the screen 32 to which the beam 54B is directed. Those phosphors emit light beams in accordance with the amount of beams directed thereto and those light beams are conbined to form a light of a desired color.

The vertical scanning is identical to that shown in FIG. 4 and the explanation thereof is omitted.

Figure 17:
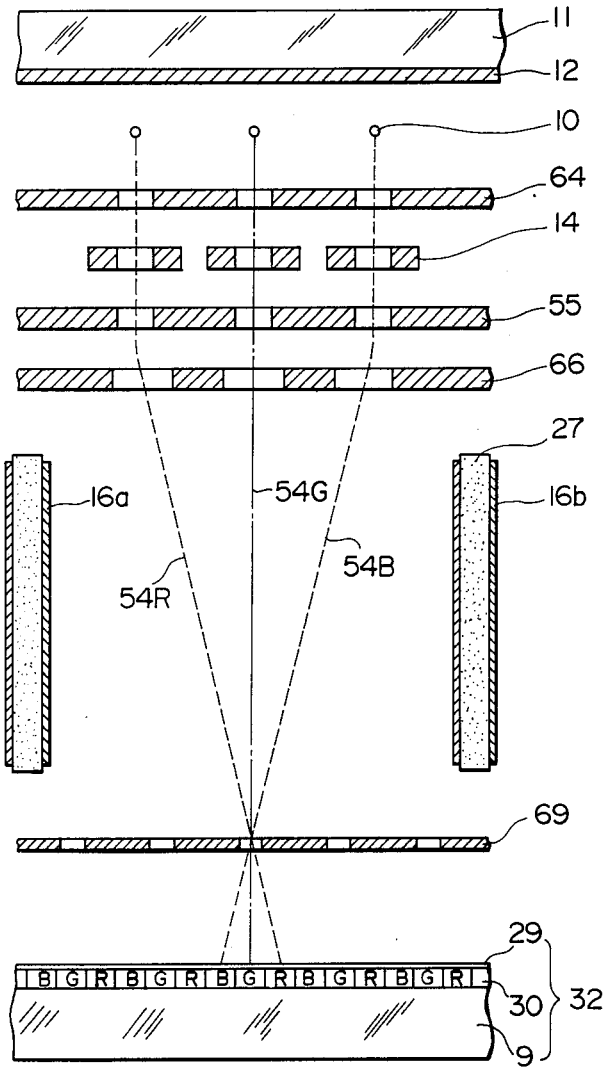
FIG. 17 is a cross-sectional view of a flat type cathode ray tube in accordance with an eighth embodiment of the present invention.

FIG. 17 shows an eighth embodiment of the present invention. A difference from the embodiment of FIG. 15 is that an auxiliary focusing electrode 55 is arranged between the modulation electrodes 14 and the beam focusing electrode 66. The auxiliary focusing electrode 55 serves to correct the defocusing of the beam when the beam is horizontally deflected, to dynamically focus the beam. The dynamic beam focusing and convergence correction functions by the beam focusing electrode 66 in the embodiment of FIG. 15 are separated in the present embodiment so that the beam focusing and the beam convergence correction are facilitated.

In the embodiment shown in FIG. 17, the beam extraction electrode 64 and the modulation electrodes 14 may be arranged in the opposite sequence.

Figure 18:
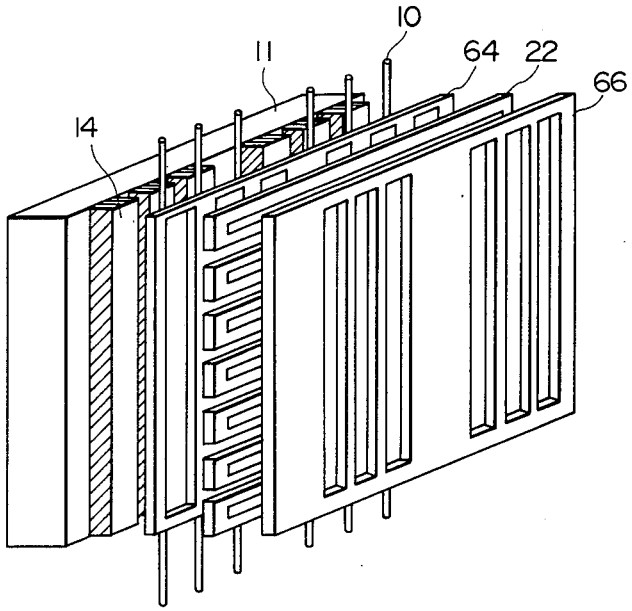
FIG. 18 is a perspective view of a flat type cathode ray tube in accordance with a ninth embodiment of the present invention.

FIG. 18 shows a ninth embodiment of the present invention. In this embodiment, the positions of the vertical scanning electrodes 12 and the modulation electrodes 14 shown in FIGS. 15 and 16 are transposed. The structure from the horizontal deflection electrodes 27 to the screen 32 is identical to that shown in FIG. 15 and the explanation thereof is omitted. Video signals are applied to the modulation electrodes 14 and modulated beams are emitted from the linear thermal cathodes 10. The beams pass through the apertures of the beam extraction electrode 64 and are vertically scanned by the vertical scanning electrodes 22. The vertical scanning electrodes 22 are separated to be of a number same as that of the number of the horizontal scanning lines. Each of the vertical scanning electrodes 22 has a horizontally extending slit or a rectangular opening which is oposite to the aperture of the beam extracting electrode 64 and has a length at least equal to the horizontal length of the aperture. The operation is identical to that of the embodiment of FIG. 15, and hence the explanation thereof is omitted. The beams transmitted through the vertical scanning electrodes 22 are focused onto the shadow mask (not shown) by the beam focusing electrode 66 and three beams are converged. The rest of the operation is identical to that of the embodiment of FIG. 15.

The embodiment shown in FIG. 18 can be applied to the embodiment shown in FIG. 17. In FIG. 17, the positions of the modulation electodes 14 and the vertical scanning electrodes 12 are transposed and apertures are formed in the vertical scanning electrodes 12 to attain a similar function. In FIG. 17, the positions of the beam extraction electrode 64 and the vertical scanning electrodes 12 may also be transposed.

Figure 19:
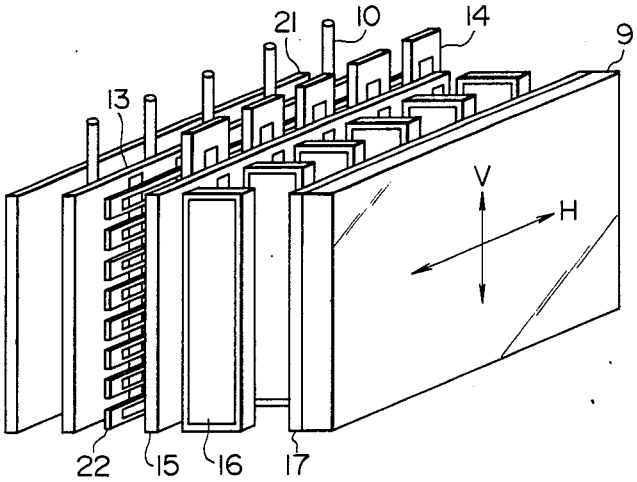
FIG. 19 is a perspective view of a flat type cathode ray tube in accordance with a tenth embodiment of the present invention.

FIG. 19 shows a tenth embodiment of the present invention. A plurality of linear thermal cathodes 10 comprising tangusten wires having a diameter of 10 to 100 μm and having oxide cathodes formed thereon are vertically arranged at a constant horizontal pitch, with appropriate tensions being applied thereto. The number of linear thermal cathodes 10 and the space therebetween are arbitrary. For example, for a television set having a display area having a diagonal dimension of 10 inches, approximately 20 linear thermal cathodes having a length of approximately 160 mm are vertically arranged at a horizontal pitch of 10 mm. A back electrode 21 made of a metal plate or an insulating plate having a conductive layer such as a metal layer or oxide formed thereon is arranged on a side of the linear thermal cathodes 10 opposite to a side thereof facing the face plate 9. Arranged between the linear thermal cathodes 10 and the face plate 9 is a first planar grid electrode 13 having apertures for focusing and accelerating election beams formed at positions corresponding to the linear thermal cathodes 10. Horizontally elongated and vertically arranged vertical scanning electrodes 22, which have electron beam transmission apertures formed therein and are divided electrically independently into a number corresponding to a number of horizontal scanning lines, are arranged to be spaced by a predetermined distance from the first grid electrode 13. Second modulation grid electrodes 14 each thereof having electron beam transmission apertures of a shape similar to that of the first grid electrode 13 formed therein and electrically separated from each other are arranged corresponding to the linear thermal cathodes 10 and spaced by a predetermined distance from the vertical scanning electrodes 22. A third grid electrode 15 having a shape similar to that of the first grid electrode 13 is arranged in spaced relation with the second modulation grid electrodes 14. Vertically elongated horizontal deflection electrodes 16 for horizontally deflecting the election beams transmitted through the electron beam transmission apertures formed in the respective electrodes are electrically independently arranged facing each other with the electron beam transmission paths intervening therebetween. The horizontal deflection electrode 16 may be formed of metal films electrically independently disposed on a surface of an insulating support or two electrically independent metal plates. A light emitting layer 17 which emits light upon stimulation by the election beams is formed on an inner surface of the face plate 9 by phosphor and a metal-back layer, in a spaced relation to the horizontal deflection electrodes 16. For monochromatic display, the phosphor may be a single layer, and for color display, red, green and blue phosphors are sequentially formed in stripe or dot, horizontally on the screen.

Figure 20:
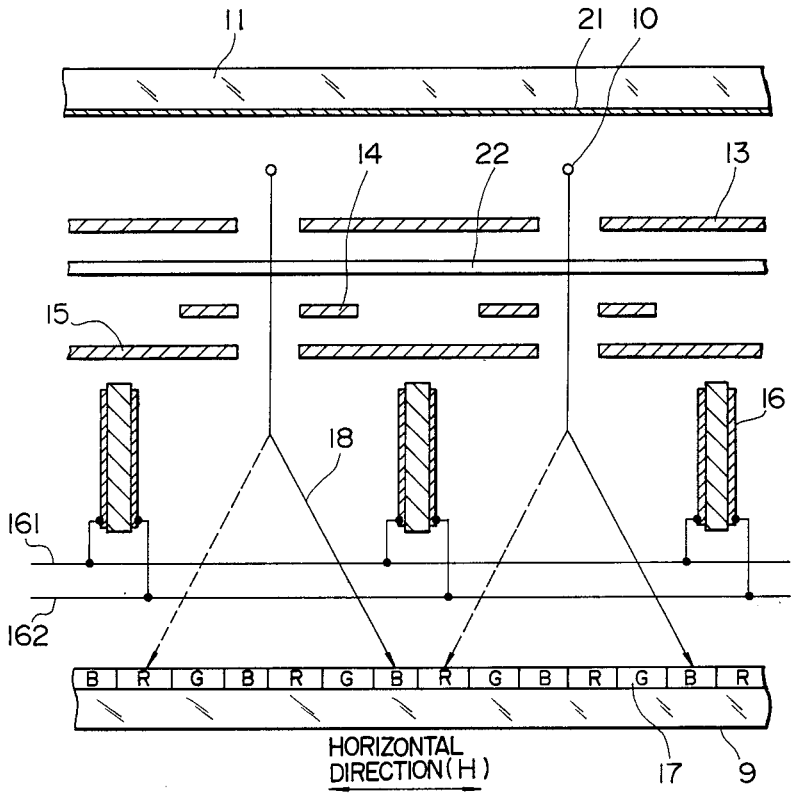
FIG. 20 is a cross-sectional view of FIG. 19.
Figure 21A:
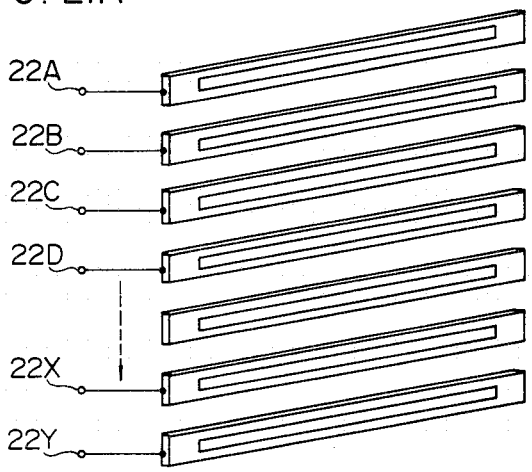
FIGS. 21A and 21B are a perspective view and a waveform chart respectively illustrating a vertical scanning operation performed by the structure shown in FIG. 19.
Figure 21B:
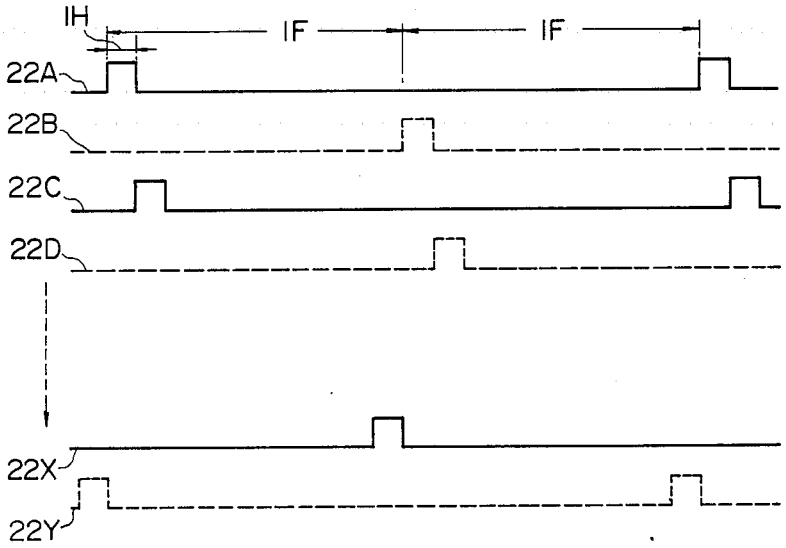

Referring to FIGS. 20, 21A and 21B, the operation of the present flat type cathode ray tube is explained. FIG. 20 is a horizontal sectional view of the flat type cathode ray tube shown in FIG. 19. The elections generated by heating the linear thermal cathodes 10 pass through the electron beam transmission apertures of the first grid electrode 13 arranged to face the linear thermal cathodes 10, by being driven by an electric field generated between the first grid electrode 13 and the back electrode 21 which may be a metal plate arranged on the back of the linear thermal cathodes 10, a metal film formed on an insulating support 11, or a metal electrode which is uniformly coated by an electrically conductive material formed of an oxide. In FIG. 20, the election beams are actually invisible, but the loci 18 thereof are shown to assist easier understanding. The electron beams uniformly generated lengthwise of the linear thermal cathodes 10 pass through the apertures of the first grid electrode 13 and are divided into individual electron beams corresponding to the respective vertical scanning lines by the electrically isolated vertical scanning electrodes 22 which are of a number corresponding to that of the horizontal scanning lines of the television system (e.g. 525) and which are arranged vertically in the longitudinal direction of the linear thermal cathodes 10. The operation of the vertical scanning electrodes 22 is now explained with reference to FIGS. 21A and 21B.

Modulating signals for turning on and off the electron beams generated by the linear thermal cathodes 10 are sequentially applied to the vertical scanning electrodes 22. When the scanning is effected under the standard television system (NTSC), in a first field (1F), signals which turn on the election beams only for one horizontal scanning period (1H-period) are sequentially applied to every other vertical scanning electrodes 22A, 22C, . . . 22X, and the scan for the first field is terminated. In a second field which is to be interlaced with the first field, signals which turn on the electron beams only for 1H-period are sequentially applied to every other vertical scanning electrodes 22B, . . . 22Y. When the signal is applied to the electrode 22Y, the scan for one frame is completed, and an image, character, etc. is formed on the screen. Turning back to FIG. 20, the electron beams generated by the linear thermal cathodes 10 are divided into beams corresponding in number to the horizontal scaning lines by the vertical scanning electrodes 22, and the electron beams are modulated (e.g. pulse-width modulated) by the second modulation grid electrodes 14 which are electrically separated and provided one for each linear thermal cathode. Actually, for color display, color sequential modulation signals of red, green, blue, red, green, blue, . . . for the image or characters to be displayed are applied to the respective ones of the second grid electrodes 14. The modulated electron beams are then shielded and horizontally focused by the third grid electrode 15 having the similar shape as the first grid electrode 13, and they are then horizontally deflected by a predetermined width by the horizontal deflection electrodes 16 so that an opposed pair thereof face an electron beam emitted from each linear thermal cathode 10. Sawtooth or stepwise horizontal deflection signals are applied to the opposing electrodes of the horizontal deflection electrodes 16 through common lines 161 and 162. The horizontally deflected electron beams are then electrically accelerated and sequentially scan selected positions of the light emitting layer 17 which is formed on the inner surface of the face plate 9 and comprises the phosphor 30 and the metal-back 29. For obtaining color display on the screen, the electron beams are horizontally deflected and the modulation signals are applied to the second grid electrodes 14 to cause the electron beams to impinge on respective predetermined color positions so that a color image or character is displayed on the screen.

Figure 22:
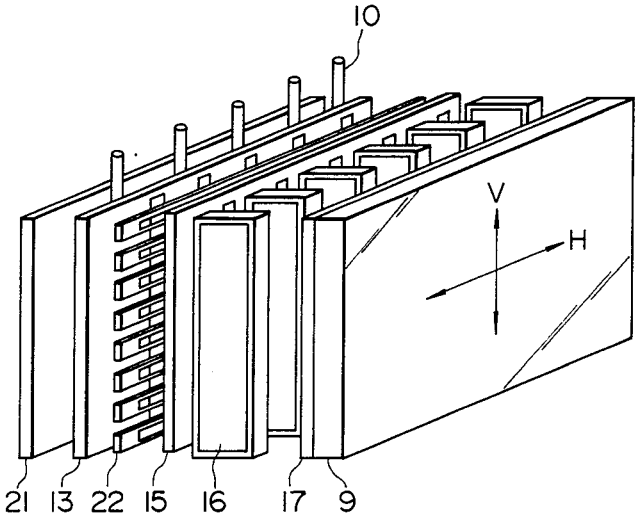
FIG. 22 is a perspective view of a flat type cathode ray tube in accordance with an eleventh embodiment of the present invention.

Next, an eleventh embodiment of the present invention will be described with reference to FIG. 22. A difference from the structure of FIG. 19 is that the second modulation grid electrodes 14 of FIG. 19 are omitted. Other electrode structures are identical.

In the operation, the electron beams modulated by the linear thermal cathodes 10 are taken out in the same manner as that described in connection with FIG. 6. The electron beams generated and modulated by the linear thermal cathodes 10 pass through the electron beam transmission apertures of the first grid electrode 13 by the potentials applied to the back electrode 21 on the back of the linear thermal electrode 10 and the first grid electrode 13. Then, the vertically uniform electron beams are vertically switched (scanned) and interlaced by the vertically scanning electrodes 22 which are perpendicular to the linear thermal cathodes 10, correspond in number to the number of horizontal scanning lines and are electrically separated from each other. Then, the electron beams are focused and horizontally deflected by the third grid electrode 15 and the horizontal deflection electrodes 16, respectively so that they scan selected areas of the light emitting layer 17, which is formed on the inner surface of the face plate 9 and comprises the phosphor layer and the metal-back layer, to display the image or character on the screen.

In the eleventh embodiment, the modulation electrodes 14 arranged one for each linear thermal cathode 10 in the tenth embodiment can be omitted by applying the modulation signals to the linear thermal cathodes 10.

Figure 23:
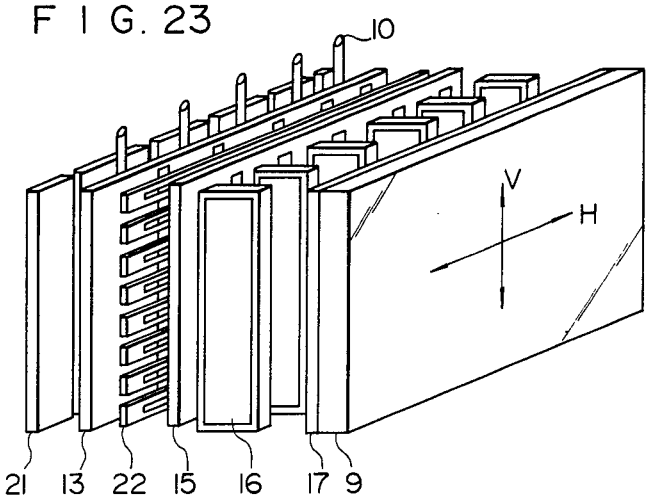
FIG. 23 is a perspective view of a flat type cathode ray tube in accordance with a twelveth embodiment of the present invention.

FIG. 23 shows a twelfth embodiment of the present invention. In this embodiment, the back electrode 21 in FIG. 22 is horizontally and electrically divided into sections, one for each linear thermal cathode 10. Other electrode structures are identical with those in FIG. 22. In the present flat type cathode ray tube, pulse width modulation signals modulated by video signals are sequentially applied to the back electrodes 21 arranged corresponding to the respective linear thermal cathodes 10 to control the amount of electrons emitted by the linear thermal cathodes 10 thereby to modulate the electron beams. The subsequent operation is similar to that of the embodiment of FIG. 22.

In the present embodiment, only the heating power supply need be connected to the linear thermal cathodes 10 and no special consideration is required for the modulation circuit. The modulation back electrodes 21 may be divided metal plates, while, they may be electrically isolated conductors formed on an insulating support because no provision of electron beam transmission apertures is necessary. In this case, it is possible to increase the strength of the electrodes and to facilitate the manufacture of the electrodes.

Figure 24:
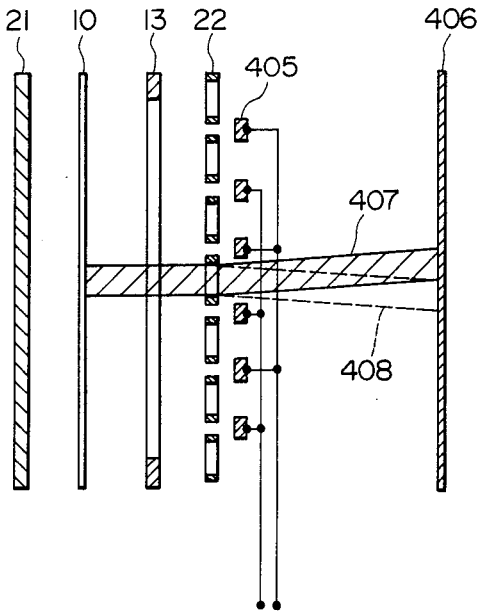
FIG. 24 is a longitudinal sectional view of a flat type cathode ray tube in accordance with a thirteenth embodiment of the present invention.

FIG. 24 shows a thirteenth embodiment of the present invention. FIG. 24 is a sectional view viewed from a side of the flat type cathode ray tube. Certain portions which are not relevant to the present invention are omitted. Electron beams generated by heating linear thermal cathodes 10 extending vertically in parallel to the screen pass through slit or dot-shaped apertures formed in a first grid electrode 13 to face the linear thermal cathodes 10, by a back electrode 21 arranged on the back of the linear thermal cathodes 10 and the first grid electrode 13 which is a beam extraction electrode. (Portions 407 and 408 of electron beam flows are shown by the continuous lines and broken lines respectively.) The electron beams are vertically scanned by turning on and off the electron beams by the vertically arranged electrically isolated vertical scanning electrodes 22 which are of a number half that of the horizontal scanning lines. Then, the electron beams are deflected by applying predetermined deflection voltages to the interlace electrodes 405 which are composed of two groups of electrode sections alternately supplied with two different potentials and which face the beam transmission apertures of the vertical scanning electrodes 22. The electron beams are vertically interlaced such that the electron beams do not cause the same area of the anode 406 to emit light during a scan of each field. The subsequent operation for the interlaced electron beams is similar to that in the embodiments of FIGS. 19 and 22.

In the present embodiment, the number of vertical scanning electrodes can be reduced to one half of the number of horizontal scanning lines. Accordingly, the manufacture of the electrodes and the wiring are simpler than those in the previous embodiments.

Figure 25A:
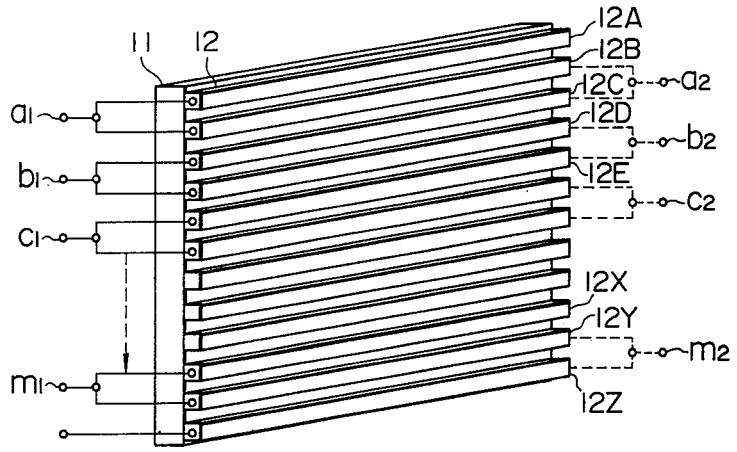
FIGS. 25A and 25B are a perspective view and a waveform chart illustrating another vertical scanning operation of the flat type cathode ray tube of the present invention.
Figure 25B:
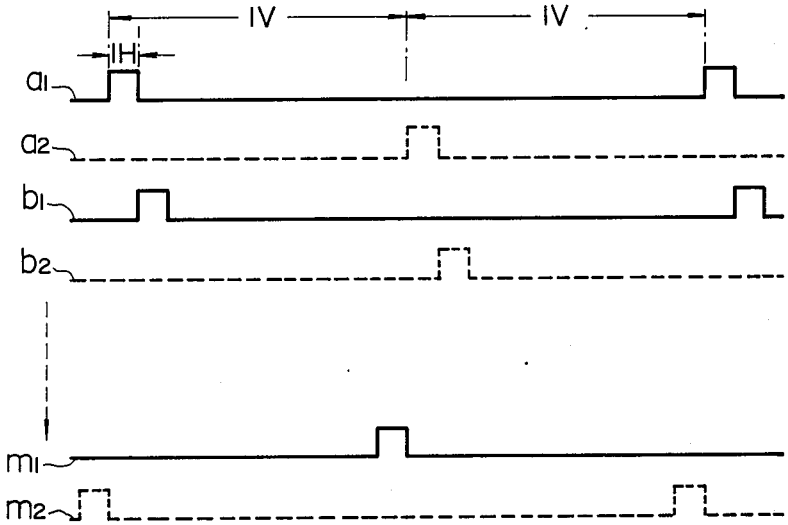

FIGS. 25A and 25B show another embodiment of the vertical scanning of the flat type cathode ray tube of the present invention.

For a television display, as many vertical scanning electrodes 12 as the number of horizontal scanning lines (490) are vertically and electrically independently arranged. As shown in FIG. 25A, electric potentials for turning off the electron beams generated by the linear thermal cathodes 10 for a predetermined period are applied to the divided electrodes 12A, 12B, 12C, . . . 12Z of the vertical scanning electrodes 12. In a first field (1V), signals having respective potentials for turning on the electron beams only for one horizontal scanning period (1H-period) are applied to respective electrically connected electrode pairs 12A, 12B; 12C, 12D; . . . ; 12X, 12Y of the vertical scanning electrodes 12 sequentially from terminals $a_1$, $b_1$, $c_1$ . . . $m_1$. Those signals are shown in FIG. 25B as waveforms $a_1$, $b_1$, $c_1$, . . . $m_1$. In a second field, the connection of the vertical scanning electrodes is changed so that 12B, 12C; 12D, 12E; . . . ; 12Y, 12Z are connected in pair. That is, each pair is vertically shifted by one pitch from that in the first field. Signals $a_2$, $b_2$, . . . $m_2$ shown by broken lines in FIG. 25B and similar to those in the first field are applied to lines $a_2$, $b_2$, . . . $m_2$. In this manner, two fields/frame scan is effected. In the present method, the interlace scanning is effected while the horizontal lines are constructed by using all of the vertical scanning electrodes 12 in each field. Because all vertical scanning electrodes are used in each field, the efficiency of utilization of beam currents is improved, light emitting brightness of the phosphor layer is improved accordingly, and a brighter image is obtained.

In FIG. 25A, the vertical scanning electrodes 12A, 12B, . . . 12Z are paired by solid lines and broken lines. It does not mean that they are actually connected in this manner but it diagramatically shows the connection in the operation. The connection and switching may be readily attained by known switching means.

The present vertical scanning method does not require a specific electrode arrangement and can be applicable to any electrode arrangement described and shown in the previous embodiments.

We claim:

1. A flat type cathode ray tube comprising:

a face plate;

one or more linear thermal cathodes for emitting electron beams, said linear thermal cathodes extending vertically in a vacuum enclosure and being arranged parallel to said face plate;

a plurality of electrically isolated vertical scanning electrodes disposed on one side of and extending perpendicularly to said linear thermal cathodes;

a plurality of planar electrodes each having electron beam transmission apertures formed therein at positions corresponding to said linear thermal cathodes and arranged on another side of said linear thermal cathodes opposite to said one side of said linear thermal cathodes at which said vertical scanning electrodes are disposed;

horizontal deflection electrodes for horizontally deflecting said electron beams emitted by said linear thermal cathodes; and a light emitting layer formed on a surface of said face plate which faces said linear thermal cathodes, said light emitting layer for emitting light beams responsive to stimulation thereof by said electron beams impinging thereon.

2. A flat type cathode ray tube according to claim 1, further comprising electrically isolated electron beam modulating electrodes each having electron beam transmission apertures formed therein at positions corresponding to said linear thermal cathodes which are arranged between said plurality of planar electrodes.

3. A flat type cathode ray tube according to claim 2, wherein said light emitting layer includes one of phosphor stripes and dots for emitting red, green and blue light beams, respectively, the electron beams are horizontally deflected by said horizontal deflection electrodes, and electron beam modulating signals for respective colors are applied to said electron beam modulating electrodes for the respective colors.

4. A flat type cathode ray tube according to claim 1, wherein a heating voltage and a modulation signal modulated by video signals are sequentially applied to said linear thermal cathodes to cause the electron beams to be emitted therefrom in accordance with the modulation signal.

5. A flat type cathode ray tube according to claim 1, wherein a signal for directing the electron beams emitted from said linear thermal cathodes to said light emitting layer only for one horizontal scanning period is applied to each of said vertical scanning electrodes to effect frame scanning of the electron beams.

6. A flat type cathode ray tube according to claim 1, wherein said vertical scanning electrodes are equal in number to one half of a number of horizontal scanning lines of said cathode ray tube, and in a first field, a pulse signal for generating the electron beams for one horizontal scanning period is applied to an n-th vertical scanning electrode, with potentials $V_{(n+1)}$ and $V_{(n-1)}$ applied respectively to (n+1)th and (n−1)th vertical scanning electrodes satisfying a relation of potential of $V_{(n+1)}<V_{(n-1)}$, and in a second field, the relation of potential is changed to satisfy a relation of $V_{(n+1)}<V_{(n-1)}$, so that an interlacing operation of the electron beams generated by the n-th vertical scanning electrode is effected between the first and second fields, and said operation is sequentially effected by each of said vertical scanning electrodes.

7. A flat type cathode ray tube according to claim 1, wherein said vertical scanning electrodes are equal in number of one half of a number of horizontal scanning lines of said cathode ray tube, and a vertical deflection means for vertically deflecting the electron beams is provided between said linear thermal cathodes and said face plate, and an interlaced operation is performed between a first field scanning and a second field scanning.

8. A flat type cathode ray tube according to claim 1, further comprising means for applying signals for generating the electron beams only for one horizontal scanning period alternate ones of said vertical scanning electrodes in a first field, and means for applying signals for generating said electron beams only for a second horizontal scanning period to remaining interlaced alternate ones of said vertical scanning electrodes in a second field.

9. A flat type cathode ray tube according to claim 1, wherein said plurality of planar electrodes comprises in sequence an electron beam extracting electrode, a shield electrode and a beam focusing electrode, with said transmission apertures being arranged to correspond to said linear thermal cathodes.

10. A flat type cathode ray tube according to claim 1, further comprising means for applying a signal to said vertical scanning electrodes and measn for applying a D.C. voltage and one of a sawtooth and a stepwise wave signal synchronized with said signal applied to said vertical scanning electrodes to said linear thermal cathodes.

11. A flat type cathode ray tube according to claim 1, further comprising means for applying a signal to said vertical scanning electrodes and means for applying a combination of a D.C. voltage with a video signal and one of a sawtooth and a stepwise wave signal synchronized with said signal applied to said vertical scanning electrodes to said linear thermal cathodes.

12. A flat type cathode ray tube according to claim 1, further comprising means for sequentially applying potential signals for causing to pass or generating electron beams only for one horizontal scanning period to each of adjacent pairs of said vertical scanning electrodes in a first field and for sequentially applying said potential signals to each of adjacent pairs of said vertical scanning electrodes vertically shifted by one electrode in a second field so that interlaced frame scanning is effected.

13. A flat type cathode ray tube according to claim 1, wherein said vertical scanning electrodes are equal in number to a number of horizontal scanning lines associated with said cathode ray tube.

14. A flat type color cathode ray tube comprising:

an image screen comprising a face plate which forms a part of a vacuum enclosure;

a shadow mask disposed facing said image screen in said vacuum enclosure;

3n ($n \leqq 1$) vertically extending linear thermal cathodes for emitting electron beams arranged horizontally with respect to said image screen in said vacuum enclosure;

a plurality of electrically isolated vertical scanning electrodes of a number corresponding to that of horizontal scanning lines arranged perpendicularly to said linear thermal cathodes in said vacuum enclosure;

a planar electron beam extracting electrode having electron beam transmission apertures formed therein at positions thereof facing said linear thermal cathodes;

a beam facing and converging electrode for focusing and converging each set of three electron beams emitted by said linear thermal cathodes on said shadow mask;

horizontal deflection electrodes disposed in opposed pairs, each for horizontally deflecting a respective said set of three electron beams emitted by said linear thermal cathodes;

a light emitting layer including red, green and blue phosphors and a metal backing layer formed on an inner face of said face plate of said image screen;

whereby said electron beams sequentially stimulate predetermined positions of said light emitting layer to form an image on said image screen.

15. A flat type color cathode ray tube according to claim 14, wherein said vertical scanning electrodes are arranged on one side of said linear thermal cathodes facing said vertical scanning electrodes and other electrodes are arranged on another side of said linear thermal cathodes opposite to said one side thereof facing said vertical scanning electrodes.

16. A flat type color cathode ray tube according to claim 14, wherein said beam focusing and converging electrode has apertures of a number corresponding to a number of said linear thermal cathodes, one of three apertures corresponding to each set of three electron beams has a center axis which coincides with a center axis of a central one of the electron beam transmission apertures of said electron beam extracting electrode, and the other two of said three aperture have respective center axis offsett from said center axis of said central one of the electron beams transmission apertures of said electron beam extracting electrode.

17. A flat type color cathode ray tube according to claim 14, further comprising electrically isolated electron beam modulation electrodes arranged on one side of said linear thermal cathodes, and other electrodes are arranged on another side of said linear thermal cathodes opposite to said one side thereof facing said electron beam modulation electrodes.

18. A flat type color cathode ray tube according to claim 14, further comprising means for sequentially applying a potential signal for causing to pass or generating the electron beams only for one horizontal scanning period to adjacent pairs of said vertical scanning electrodes in a first field and for sequentially applying said potential signal to adjacent pairs of said vertical scanning electrodes vertically shifted by one electrode in a second field, thereby effecting interlaced frame scanning.

19. A flat type cathode ray tube comprising:

an image screen comprising a face plate which forms a part of a vacuum enclosure;

one or more vertically extending and horizontally isolated linear thermal cathodes for emitting electron beams, said linear thermal cathodes being arranged parallel to said image screen in said vacuum enclosure;

a back electrode arranged on a side of said linear thermal cathodes opposite to a side thereof facing said image screen;

a planar grid electrode having electron beam transmission apertures formed therein at positions thereof facing said linear thermal cathodes, said planar grid electrode being arranged between said linear thermal cathodes and said image screen;

electrically isolated vertical scanning electrodes arranged perpendicularly to said linear thermal cathodes between said linear thermal cathodes and said image screen;

a planar electrode for horizontally focusing the electron beams, which is arranged between said linear thermal cathodes and said image screen;

horizontal deflection electrodes for horizontally delfecting said electron beams, said horizontal deflection electrodes being arranged between said linear thermal cathodes and said image screen; and a light emitting layer including at least one phosphor and a metal-backing layer formed on an inner surface of said face plate on said image screen.

20. A flat type cathode ray tube according to claim 19, wherein said back electrode includes horizontally separated and vertically elongated electrodes which are arranged to correspond to said linear thermal cathodes.

21. A flat type cathode ray tube according to claim 19, further comprising means for sequentially applying an electrical signal for transmitting the electron beams only for one horizontal scanning period to every other vertical scanning electrodes in a first field and for sequentially applying said signal to remaining every other vertical scanning electrodes in a second field, thereby effecting an interlaced scanning operation.

22. A flat type cathode ray tube according to claim 19, wherein said vertical scanning electrodes are equal in number to one half of a number of horizontal scanning lines associated with said cathode ray tube, vertical deflection electrodes for vertically deflecting the electron beams transmitted through said vertical scanning electrodes are arranged between said vertical scanning electrodes and said face plate, and positions of the electron beams are vertically shifted from each other between a first field and a second field thereby to perform an interlaced scanning operation.

23. A flat type cathode ray tube according to claim 19, further comprising means for generating a video signal and means for sequentially applying a heating voltage and a modulation signal modulated by said video signal to said linear thermal cathodes to extract therefrom electron beams modulated by the video signal.

24. A flat type cathode ray tube according to claim 20, further comprising means for generating a video signal and means for applying a modulation signal modulated by said video signal to said back electrode, which is divided to correspond to said thermal cathode, to turn on and off the electron beams generated from said linear thermal cathodes.

25. A flat type cathode ray tube according to claim 19, further comprising means for sequentially applying a potential signal for causing to pass or generating the electron beams to adjacent pairs of said vertical scanning electrodes in a first field and for sequentially applying said potential signal to adjacent pairs of said vertical scanning electrodes vertically shifted by one electrode in a second field, thereby effecting an interlaced frame scanning operation.

26. A flat type cathode ray tube according to claim 19, whrein said vertical scanning electrodes are equal in number to a number of horizontal scanning lines associates with said cathode ray tube.

* * * * *